US006543773B2

(12) United States Patent
Mims

(10) Patent No.: US 6,543,773 B2
(45) Date of Patent: Apr. 8, 2003

(54) CARD GAME

(76) Inventor: Walter Mims, 3454 Heather La., Birmingham, AL (US) 35216

( * ) Notice: Subject to any disclaimer, the term of this patent is extended or adjusted under 35 U.S.C. 154(b) by 0 days.

(21) Appl. No.: 09/908,982

(22) Filed: Jul. 20, 2001

(65) Prior Publication Data

US 2002/0033577 A1 Mar. 21, 2002

Related U.S. Application Data

(63) Continuation of application No. 09/337,347, filed on Jun. 21, 1998, now abandoned.
(60) Provisional application No. 60/101,375, filed on Sep. 22, 1998.

(51) Int. Cl.[7] ..... A63F 1/00
(52) U.S. Cl. ..... 273/292; 273/274; 463/13
(58) Field of Search ..... 273/292, 274, 273/303; 463/13

(56) References Cited

U.S. PATENT DOCUMENTS 5,013,049 A 5/1991 Tomaszewksi
5,265,882 A 11/1993 Malek
5,288,077 A * 2/1994 Jones
5,288,082 A 2/1994 Marquez
5,322,295 A 6/1994 Cabot et al.
5,377,993 A 1/1995 Josephs
5,395,120 A 3/1995 Malek
5,407,209 A 4/1995 Prerost
5,522,595 A 6/1996 Wong
5,597,162 A 1/1997 Franklin
5,636,842 A 6/1997 Cabot et al.
5,636,843 A 6/1997 Roberts
5,678,821 A 10/1997 Hedman
5,702,104 A 12/1997 Malek et al.
5,707,285 A * 1/1998 Place et al. ..... 273/292
5,713,574 A * 2/1998 Hughes ..... 273/292
6,012,719 A * 1/2000 Webb

* cited by examiner

*Primary Examiner*—Benjamin H. Layno
*Assistant Examiner*—V K Mendiratta
(74) *Attorney, Agent, or Firm*—Dowell & Dowell, P.C.

(57) ABSTRACT

A card game in which, after bets are made by a player, three cards are dealt to the player by the dealer who also receives three cards. Thereafter the player selects two of the three dealt cards to play in the manner of a came of conventional "Blackjack". After the player plays, the dealer selects two of three cards for dealer play. In a varied embodiment, the player may optionally bet on whether the player's initially dealt cards equal a predetermined winning combination of cards which is predesignated such as three of a kind, a straight, a flush, or a straight flush with the odds being posted for such preliminary bets.

2 Claims, 2 Drawing Sheets

CARD GAME

CROSS REFERENCE TO RELATED APPLICATIONS

This application continuation of and claims benefit from U.S. Provisional Patent Application No. 60/101,375, entitled "Card Game", filed Sep. 22, 1998, and U.S. patent application Ser. No. 09/337,347 filed Jun. 21, 1999, now abandoned also entitled "Card Game" in the name of the same inventor.

BACKGROUND OF THE INVENTION

1. Field of the Invention

This invention is generally directed to card games and games of chance and, more particularly, to a method of playing a variation of the game of "Blackjack" or "Twenty-One".

2. Brief Description of the Related Art

A number of patents have been issued for various card games and/or methods for playing such games. The following is a list of recent U.S. patents directed to card games and the like related to the game "Blackjack", also commonly known as "Twenty-One": U.S. Pat. Nos. 5,702,104; 5,678,821; 5,636,843; 5,636,842; 5,407,209; 5,395,120; 5,377,993; 5,288,082; 5,288,077; and 5,265,882.

SUMMARY OF THE INVENTION

The present invention is directed to a card game and to a game of chance and method of playing the game which involves a variation of a conventional game of "Blackjack" or "Twenty-One". The present game is preferably played between a dealer who represents a banker, such as casino employee and one or more players, however, the game may also be played electronically between a player and a video or image display controlled by appropriate computer. The game is initiated by a player placing a preliminary bet against the dealer or the house after which the dealer deals three cards to each player. The dealer then deals three cards to him or herself. Thereafter, the players choose two of the three cards for continued play in the manner of a conventional "Blackjack" game or game of "Twenty-One". Either before or after a player plays, the dealer also chooses two of the cards dealt to the dealer for use in dealer play after the players play.

As a variation of the game of the present invention, prior to the dealer dealing cards to the players, each player may make a side bet against the house or bank with respect to obtaining a predetermined or preselected winning combination of cards. By way of example, the house or dealer may allow bets to the effect that if a player receives three of a kind, a flush, or a straight flush utilizing the three cards dealt to the player, such player will receive payment against their bet on a predetermined odds basis. For example, the house may determine that three of a kind would constitute a 50 to 1 pay off and that three of a kind of the same suit, wherein a plurality of decks of conventional cards are utilized, may pay off at 500 to 1. The odds would be predetermined by the dealer or the bank/casino. Determination of the side bet is made before the player selects the two cards to be played and completes play in the conventional manner of a game of "Blackjack" or "Twenty-One".

DESCRIPTION OF THE PREFERRED EMBODIMENTS

Figure 1:
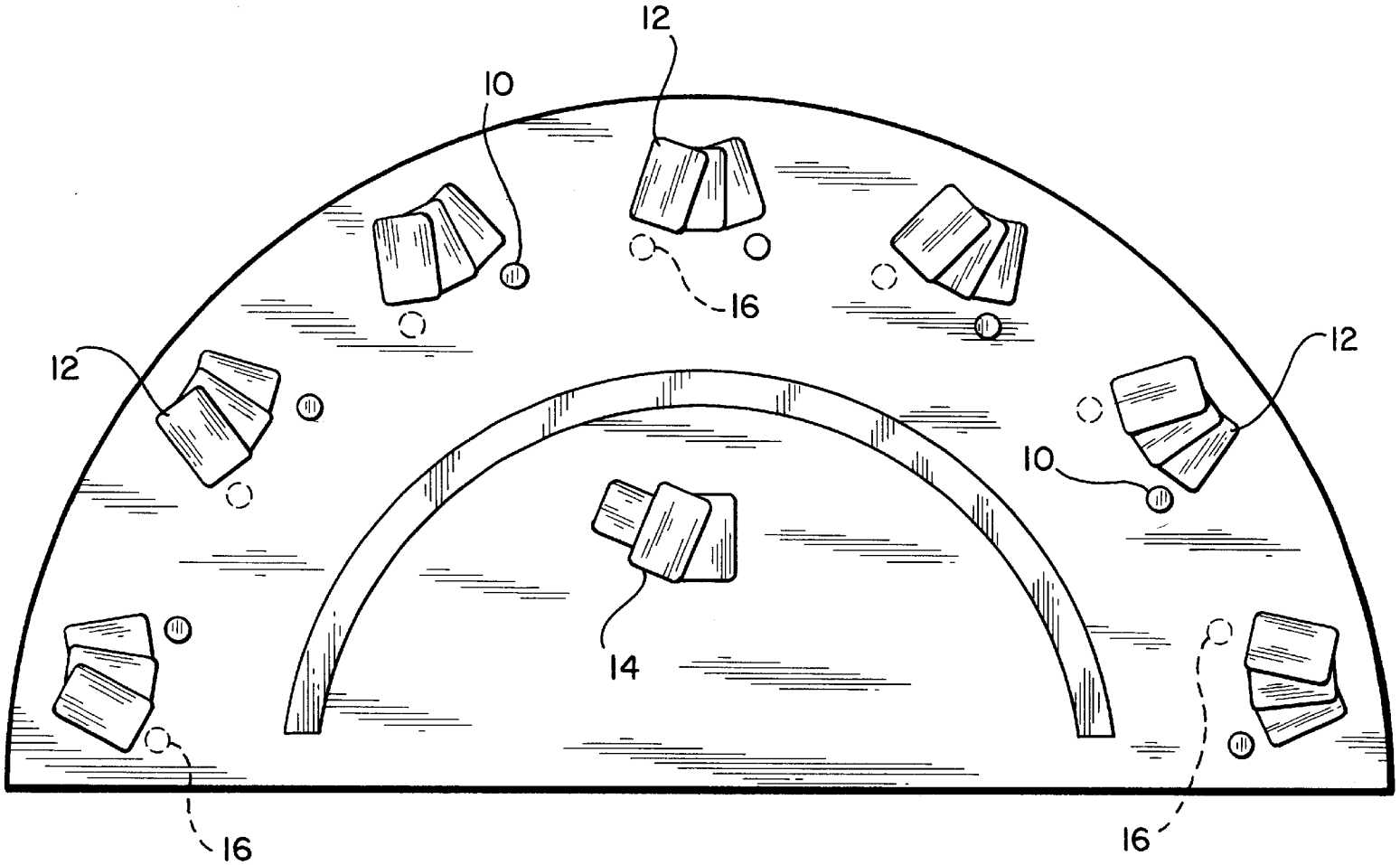
FIG. 1 is an illustrational view of a casino table or an image of a table on a video screen showing a dealer position and a plurality of player positions wherein each player is initially dealt three playing cards with the dealer also being dealt three cards and showing initial wagers being placed by each player prior to the initiation of game play.

With continued reference to the drawings, the present invention is directed to an improvement over the conventional game of "Blackjack" or "Twenty-One". The game may involve the use of either conventional playing cards or video simulations thereof and may, in some instances, involve the use of multiple decks of cards or simulated cards. The object of the game is for each player to beat the dealer or banker by having cards that have a higher total point value than the dealer's cards without the player's cards exceeding twenty-one.

For purposes of playing the card game of the present invention, the card values are treated as they are in a conventional game of "Blackjack". Cards designated two to ten count at their face value while picture cards, such as the Jack, Queen and King count as ten points. Each Ace may be counted as a one or as an eleven in a total point count.

To initiate game play, each player makes a preliminary bet or wager by placing a chip, token or other object 10 representing a value on the playing surface or by selecting a wager amount and entering that amount in a game machine. Once each player has placed a wager, the dealer will deal three player cards 12 to each player which may be dealt one card per player, in sequence, or three cards to each player, in sequence, and thereafter, the dealer deals three dealer cards 14 to him or herself. Once the cards are dealt, each player reviews the three cards and selects two of the cards for continued game play in the manner of a conventional game of "Blackjack" or "Twenty-One". The third card is discarded. The dealer also selects two of his or her dealt cards for continued play and discards the third card. In some variations of the game, the dealer may await making a selection of two cards of the three dealt until after the players have played their hands in the conventional manner of "Blackjack" or "twenty-one".

Normally, play begins with the first player to a dealer's left. After choosing two of the three cards dealt to the player, the player must decide whether to "stand" on the cards dealt as they total towards an amount of twenty-one points or attempt to improve the point total by requesting a "hit". When a player requests a "hit", the dealer will place an additional card face up, which card reflects a point total which must be added to the point total of the players two cards selected to play the hand. Play proceeds in a like manner until a player decides to "stand" on the hand as complete. If the player's hand exceeds twenty-one points, the player looses the bet and the game is over for that player.

After all players have finished, the dealer plays his or her hand, provided that at least one of the players has not exceeded the twenty-one point count total. If the dealer has not initially selected two of the three cards dealt to the dealer, such selection is first made and the extra card discarded. Thereafter the dealer plays the hand. Should the dealer exceed the twenty-one points, any player who has not exceeded the twenty-one points is paid in the amount of their initial wager by the dealer, house or banker. In some cases, it may be determined that players with the same score as the dealer will "tie" the dealer and therefore no payment would be made on or against the wager. Because players play first, if a player exceeds the twenty-one point value prior to the dealer dealing cards to him or herself, the player must pay the wager to the dealer, house or bank.

Figure 2:
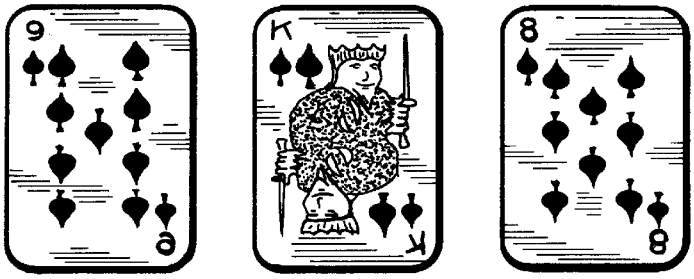
FIG. 2 is an illustrational view showing three cards having the same suit and constituting a flush for purposes of determining side bets.
Figure 3:
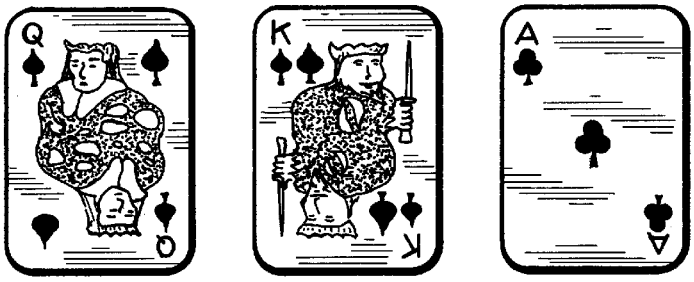
FIG. 3 is a view showing three cards illustrating a straight for purposes of determining side bets.
Figure 4:
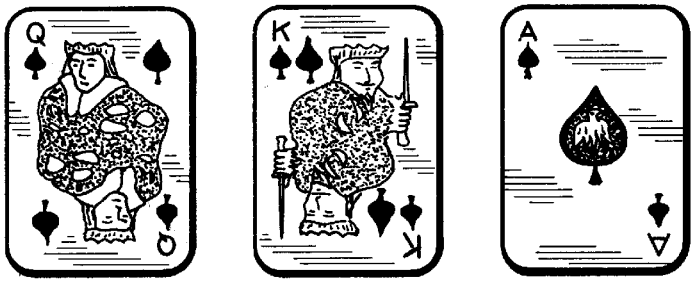
FIG. 4 is a view of three cards illustrating a straight flush for purposes of determining side bets.
Figure 5:
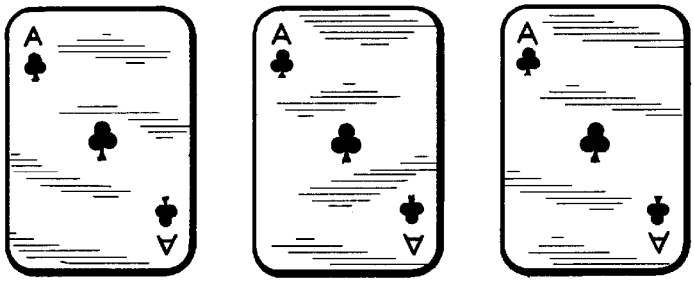
FIG. 5 is a view of three cards illustrating three of a kind of the same suit for purposes of determining side bets.

As a variation to the above embodiment of the present invention, before start of play, each player may make a side bet or wager 16 based upon receiving any number of combinations of the three cards to be initially dealt to the player. For instance, the dealer, house or banker may predetermine that a player may wager that, if the player receives three cards of the same suit, such a "flush", see FIG. 2, would constitute a win for which the odds would be predetermined to be 10 to 1 on the side bet. As a variation, the house may predetermine that three cards all in a sequence, such as a queen, king and ace, see FIG. 3, would constitute a "straight" with pay off odds of 10 to 1. In a like manner, the house may also determine that a straight flush, i.e. cards in consecutive sequence of the same suit, see FIG. 4, would have the odds of 60 to 1 or that three cards of the same suit and of the same kind, such as three aces of clubs, see FIG. 5, would have an odds payoff of 500 to 1. The last example would require that play be initiated with at least three decks of cards constituting the initial deck set for the game. Any number of combinations may be predetermined as winning combinations which may be the subject of wagers as side bets made by each player. Side bets or wagers are placed before a player reviews or sees his or her cards. Determination of winning such a side bet is made before the player chooses two cards for play in the variation game of "Blackjack" or "Twenty-One". After that determination, the two cards are selected and the non-selected card is discarded.

Although not specifically shown in the drawings figures, the game of the present invention may also be played electronically. In such circumstances, a computer would control the display of player cards on an appropriate video screen with the player being able to select two of the three cards dealt to the player for continued play. Wagering would be done by entering the wager into the game machine or computer in a conventional manner as is currently done for other games of chance in casinos and other gambling establishments. Side bets can also be made against the dealer/house in the same manner as discussed above with respect to the embodiment wherein physical playing cards are utilized. In view of the foregoing, the use of the term "cards" within the meaning of the present invention relates not only to physical playing cards but also to cards which are simulated in computer form or on a video display for purposes of playing the game as outlined above.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A method of playing a card game in which one or more players play against a dealer, the method comprising:

a player making a first wager;

the dealer dealing three cards from a set of cards to the player and three cards from the set of cards to the dealer;

the player selecting two of the three cards first dealt to the player to play and discarding an unselected third card;

the player standing or being dealt at least one additional card from the set of cards by the dealer as the player requests in accordance with the conventional rules of play of Blackjack, such that the player's two selected and all additional cards dealt to the player define a player's hand;

the dealer selecting two of the three cards first dealt to the dealer and discarding an unselected third card;

the dealer standing or being dealt at least one additional card from the set of cards in accordance with the conventional rules of play of Blackjack, such that the dealer's two selected cards and any additional cards dealt to the dealer define a dealer's hand;

the dealer thereafter comparing the dealer's hand to the player's hand in accordance with the conventional rules of play of Blackjack; and the dealer paying winnings or collecting a losing first wager.

2. The method of claim 1 further comprising: prior to being dealt said first three cards, the player making a side wager that the first three cards dealt to the player will make up one of predetermined combinations of three cards; and the dealer paying side wager winnings to the player dealt three cards when the first three cards make up one of said predetermined combinations of three cards and collecting a losing side wager from the player when the dealt first three cards do not making up one of said predetermined combinations of three cards.

* * * * *